US005469581A

United States Patent [19]

Uthoff

[11] Patent Number: 5,469,581

[45] Date of Patent: Nov. 28, 1995

[54] SPORTS GARMENT HAVING VARIABLE THICKNESS SECTIONS

[75] Inventor: David C. Uthoff, Wickenburg, Ariz.

[73] Assignee: Corporate Concept Marketing, Northville, Mich.

[21] Appl. No.: 208,476

[22] Filed: Mar. 10, 1994

[51] Int. Cl.[6] ..... A41B 1/00

[52] U.S. Cl. ..... 2/69; 2/115; 2/90; 2/272

[58] Field of Search ..... 2/69, 90, 115, 2/DIG. 4, 106, 243.1, 272, 108, 81, 82

[56] References Cited

U.S. PATENT DOCUMENTS 4,722,099 2/1988 Kratz .
4,783,858 11/1988 Chevalier .
4,843,646 7/1989 Grilliott et al. ..... 2/69
5,105,478 4/1992 Pyc .
5,218,720 6/1993 Tolton .
5,282,277 2/1994 Onozawa ..... 2/69

FOREIGN PATENT DOCUMENTS 2527905 12/1983 France .
638665 10/1983 Switzerland ..... 2/69

*Primary Examiner*—C. D. Crowder
*Assistant Examiner*—Gloria Hale

[57] ABSTRACT

A sports garment for warmth with freedom of movement having thin sections and thick sections where inner arm areas and inner torso areas defined by the area of contact between the arms and torso of the wearer during a swinging motion are formed out of a relatively thin material for freedom of motion and where the other areas of the garment are formed of a thicker insulating material for warmth.

5 Claims, 2 Drawing Sheets

FIG 1
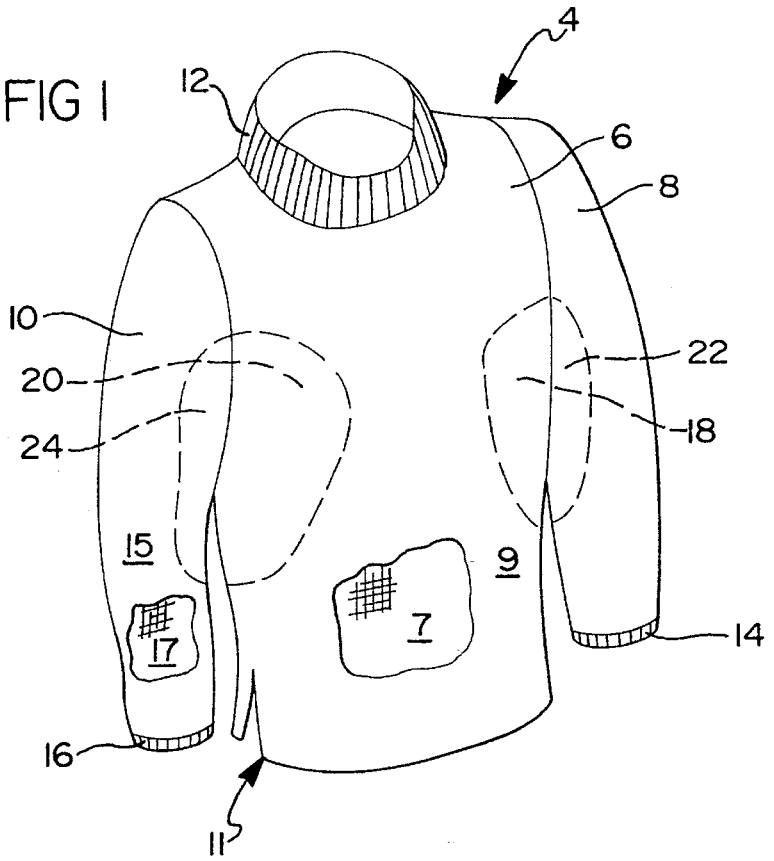
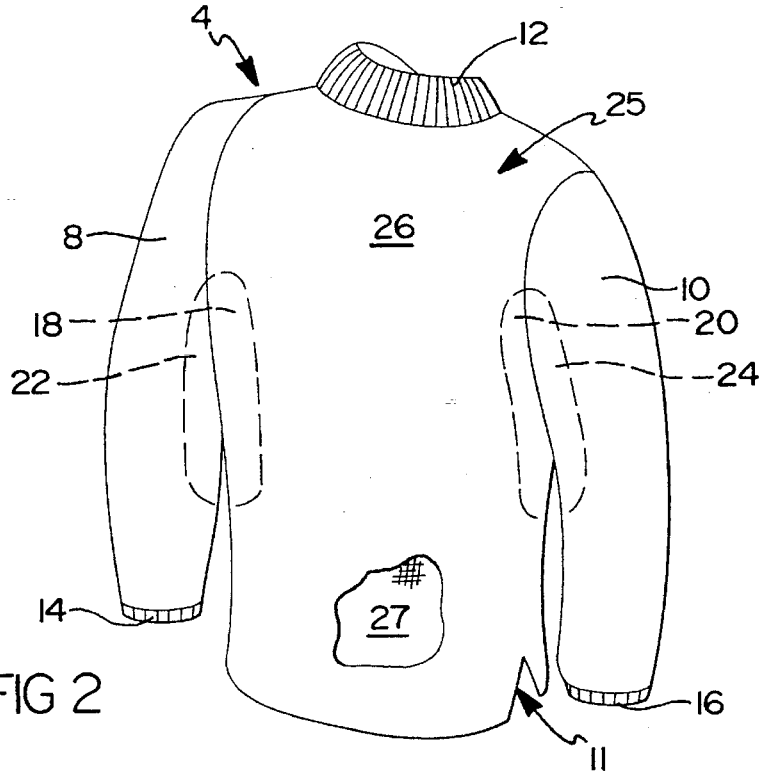
FIG 2

FIG 3
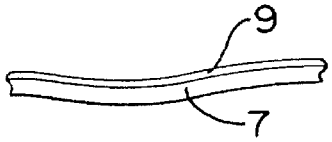
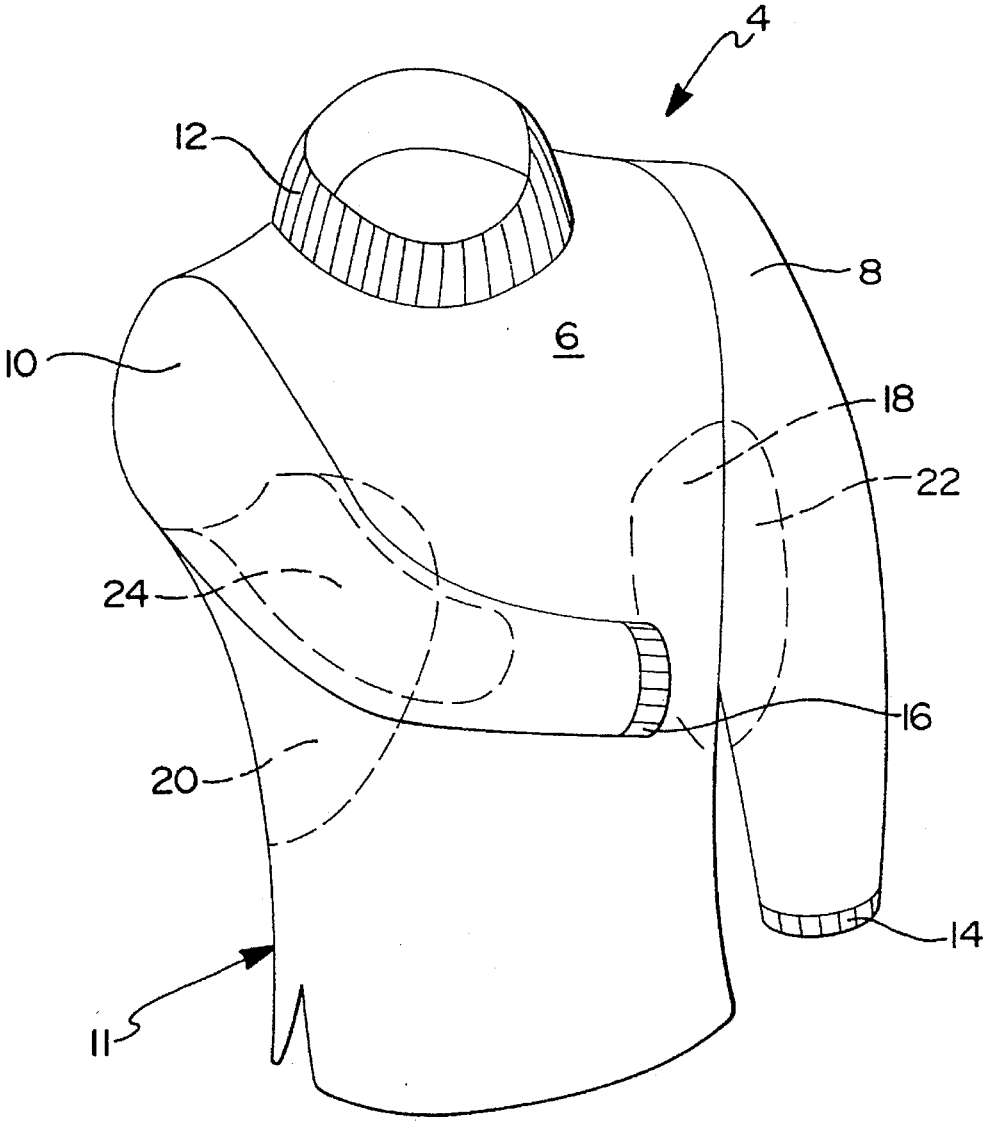
FIG 4

SPORTS GARMENT HAVING VARIABLE THICKNESS SECTIONS

BACKGROUND OF THE INVENTION

The present invention relates to the field of upper body garments and, more particularly, to such a garment worn while engaged in the playing of sports which provides warmth to the wearer with increased freedom of motion.

In order to provide the necessary warmth during outdoor activities in cold weather, it has been customary to wear various over garments such as jackets, sweatshirts, vests, shirts or sweaters. The use of these types of garments inhibits bodily motion especially during sports activities such as golf or tennis where the arms are swung across the torso. The bulk of such outer garments restricts the force and speed of the player's motion and also alters the synchronization between the movement of the arms, torso and legs resulting in a degradation in the wearer's performance.

Sports, such as tennis or golf require an extended range of motion in the player's arms as the swing is made. One problem with prior art garments is due to their design, where a heavy single thickness of material is used for both the torso and sleeve sections. The material between the wearer's arms and torso adds bulk thereby inhibiting freedom in the swinging motion which degrades the wearer's playing ability. Attempts to eliminate binding created by the relatively thick material of the garment are made by wearing a garment one or more sizes larger than necessary for a normal fit which is not aesthetically pleasing nor desirable from a performance standpoint.

U.S. Pat. No. 5,105,478, the disclosure of which is hereby incorporated by reference, discloses a shirt having relatively narrow mesh panels under the wearer's arms to provide additional ventilation. The panels are made of material with a high degree of ventilation which is shown in the disclosure as elongated mesh inserts disposed along the seams of the shirt body and each sleeve. In addition, a portion of non-mesh material is disposed under the back of the wearer's arms to absorb perspiration. The purpose of the garment is to provide relief from hot weather. No reference is made to a variation in thickness of the different sections of the shirt to facilitate freedom of movement and thus, this garment would exhibit the same swing inhibiting characteristics as other prior art garments.

One major problem with prior art garments is that to provide adequate thermal insulation for use in cold weather, the garments are made uniformly thick which inhibits freedom of motion during a golf or tennis swing.

SUMMARY OF THE INVENTION

Disclosed and claimed herein is a variable thickness upper body garment particularly adapted for wear during golf or tennis, or during other outdoor sports where freedom of movement of the arms is required while providing warmth. The non uniform thickness of the present invention provides for a thin section of material at the wearer's arms and at the sides of the wearer's torso positioned such that the thin areas under the arms and at the torso contact one another during the swing.

The garment of the present invention includes areas of insulation applied to the inside of a shirt or sweater in specific areas so as to maximize the thermal insulation to the wearer's torso while allowing the arms to more freely move. Different sports require different patterns of movement of the arms relative to the wearer's torso and the areas of thermal insulation can be customized for each sport and each athlete. According to the present invention, relatively thin areas of the garment are located under the arms and along the sides of the wearer's torso wherever the wearer's arms move along the torso during a swinging motion thereby improving the wearer's freedom of movement. The areas where the arms do not contact areas of the torso during the swing are made of a thick insulating material for warmth.

The areas of insulation can be fabricated form various natural or man made materials such as wool or material insulated with Thermolite II® made by DuPont while the thin areas can be made of a material such as nylon or Gore-Tex® made by W. L. Gore & Associates, Inc. or the complete garment can be made of a relatively thin material which is lined in specific areas with a thicker insulating layer.

One provision of the present invention is to provide a garment with increased thermal insulation qualities while providing freedom of motion to the wearer by varying the thickness of the garment.

Another provision of the present invention is to provide a garment with increased thermal insulation while providing freedom of motion to the wearer by reducing the thickness of the garment in select areas by eliminating one or more layers .

Another provision of the present invention is to provide a garment with increased thermal insulation while providing freedom of motion to the wearer by minimizing the thickness of the garment layers in the areas where the wearer's arm comes in close proximity to the torso during the playing of a sports activity,

BRIEF DESCRIPTION OF THE DRAWINGS

FIG. 1 is a perspective view of the front of the garment of the present invention;

FIG. 2 is a perspective view of the back of the garment of the present invention;

FIG. 3 is a cross-sectional view of the outer layer attached to the inner layer of the garment of the present invention; and FIG. 4 is a perspective view of the front of the garment of the present invention with one arm positioned across the chest of the wearer.

DETAILED DESCRIPTION OF THE PREFERRED EMBODIMENT

Referring to FIG. 1, a partial perspective view of the front of the garment 4 of the present invention is shown. The garment 4 includes an front panel 6 for covering the chest and abdominal areas of the wearer. The front panel 6 is constructed of a relatively thin front outer layer 9 of material such as a tightly knitted wool or cotton material or of a man-made material such as Gore-Te® or polypropylene or nylon. The front outer layer 9 overlies a thicker, insulating front inner layer 7 which can be wool or a high technology man-made insulation such as Thermolite II® made by DuPont or any other material which offers a high level of thermal insulating qualities. It is also contemplated that a multiple layer of materials may be used to make up either the front outer layer 9 and/or the front inner layer 7.

Attached to the front panel 6 are a left sleeve 8 and a right sleeve 10 to cover the left and right arms of the wearer, respectively. The left sleeve 8 and the right sleeve 10 are made of a similar or the same material construction as the front panel 6 using the sleeve outer layer 15 and the sleeve inner layer 17 attached thereto, where the sleeve outer layer 15 is relatively thin and the sleeve inner layer 17 is a thicker insulating layer. At the end of the left sleeve 8 is a left cuff 14 and likewise the right sleeve 10 has a right cuff 16. Both the left cuff 14 and the right cuff 16 can be knitted or otherwise constructed to conform to the wearer's wrists to provide sealing against wind and/or rain. A knitted collar 12 is attached to the front panel 6 which covers a portion of the wearer's neck.

In the left inner torso area 18, the front inner material 7 is removed, or its thickness is greatly reduced so as to reduce the overall thickness of the front panel 6 in the area of the wearer's underarm. The left inner torso area 18 extends horizontally from approximately the center of the wearer's rib cage rearward as far as is necessary to provide freedom of movement during the performance of the sports activity such as golf. It additionally extends vertically from under the wearer's arms (armpits) downward to approximately the last bone of the ribcage. Likewise, a right inner torso area 20 is reduced in thickness by complete removal or a significant reduction in the thickness of the front inner layer 7 to provide freedom of motion of the right arm of the wearer.

In the underarm areas of the left and right inner arm areas 22 and 24, the relatively thick sleeve inner layer 17 is removed or significantly reduced in thickness. Other material choices can be made so long as the overall thickness in the left and right inner arm areas 22 and 24 are significantly reduced as compared to the overall thickness of the left and right sleeves 8 and 10 respectively.

Both the left and the right inner arm areas 22 and 24 horizontally extend from approximately the middle of the front of the left and right sleeves 14, 16 to the middle of the back of the left and right sleeves 14, 16 when the wearer holds the arms at rest with the palms facing one another.

The purpose of constructing the garment 4 with reduced thickness in the left and right inner torso areas 18, 20 and the left and right inner arm areas 22, 24 is to provide freedom of motion during the swinging of a club or racquet while providing good thermal characteristics for maximum warmth. Typically, according to the present invention, the thin portions are less than 50% of the thickness of the balance of the garment 4.

Now referring to FIG. 2, a back elevation view of the back of the garment 4 of the present invention is shown. Similar to the front panel 6, the rear panel 25 is constructed of a relatively thin outer back layer 26 which overlies a thick back inner layer 27. The back outer layer 26 can be made of the same material as used for the front outer layer 9 and likewise the back inner layer 27 can be made of the same material used for the front inner layer 7. The front panel 6 in combination with the rear panel 25 make up a torso section 11.

Also shown is the left and right inner torso areas 18 and 20 which horizontally extend approximately to just past the left and right sleeves 8 and 10 respectively in their material positions. The left and right inner arm areas 22 and 24 are shown where they horizontally extend approximately to the middle of the back of the left and right sleeves 8 and 10 respectively. The exact shape and location of the left and right inner torso areas 18 and 20 and the left and right inner arm areas 22 and 24 can be determined for specific sports and athletes. Basically, the areas where the sleeves 8 and 10 contact the torso section 11 during the swing of a club or racquet should be constructed of a thin material with the balance of the garment being constructed of a thick insulating material.

The inner back layer 27 is removed in the areas on the left and right inner torso areas 18 and 20 while the sleeve inner layer 17 is removed in the areas of the left and right inner arm areas 22 and 24. The collar 12 is attached to the rear panel 25 along with the left and right sleeves 8 and 10 respectively attached to apertures formed by the front and rear panels 6 and 25.

FIG. 3 is a cross-sectional view of the relatively thin front outer layer 9 which is attached to the relatively thick insulating front inner layer 7 by sewing or some other type of attachment method. This Figure is also representative of the relatively thin sleeve outer layer 15 attached to the relatively thick insulating sleeve inner layer 17. FIG. 3 is also representative of the relatively thin back outer layer 26 as it is attached to the relatively thick insulating back inner layer 27. Except for the left and right cuffs 14 and 16, the collar 12, the left and right inner torso areas 18 and 20 and the left and right inner arm areas 22 and 24, the garment is made of two layers, an outer thin layer and an inner thick insulating layer. The outer layer is ideally a tightly woven material to act as a wind breaker. In the left and right inner torso areas 18 and 20, and the left and right inner arm areas 22 and 24, the inner layer 7 is removed to minimize the thickness of the garment 4 in the areas where the arms contact the torso of the wearer during the swinging of a club or racquet.

The inner layers 7, 17 and 27 can be sewn to their respective outer layers 9, 15 and 26 or the outer layers can be attached using any type of suitable fastening method including weaving the two layers together. Any of the inner layers 7, 17 and 27 and their respective outer layers 9, 15 and 26 could be fabricated as one piece by knitting with the appropriate thickness controlled by the knitting process.

The exact shape of the left and right inner torso areas 18 and 20 and the left and right inner arm areas 22 and 24 can be customized to the specific sport or even to the particular swing characteristics of the wearer so that the maximum area of the garment is lined with the inner layers 7, 17 and 27 to provide the maximum warmth without inhibiting body motion to any great extent.

FIG. 4 is a partial perspective view of the garment 4 of the present invention in which the right sleeve 10 is positioned as when the wearer is swinging a club or racquet. The right inner arm area 24 overlies the right inner torso area 20. Because of the reduced thickness in the material of both the right inner arm area 24 and the right inner torso area 20, the wearer can more freely move the arm (not shown) across the front of the body without hindrance from the garment 4 of the present invention. The majority of the garment is fully lined with the inner layers 7, 17 and 27 at full thickness for maximum thermal insulation.

The relatively thin areas of the garment can be described with reference to specific areas of the wearer's body. The left and right inner arm areas 22 and 24 extend around the inside of the wearer's arms from approximately the center of the front of the arm under the arm past the armpit to approximately the center of the back of the arm. And, extend vertically along the arm from the top of the armpit downward to approximately the wearer's elbow.

The right and left inner torso areas 18 and 20 likewise can be defined by reference to the wearer's body. The left and right inner torso areas 18 and 20 extend around the wearer's torso from approximately the center of the front of the wearer's rib cage horizontally rearward to just beyond the wearer's armpit area. The inner torso areas 18 and 20 extend vertically from the top of the wearer's armpit downward to approximately the bottom of the wearer's rib cage.

Basically, wherever the wearer's arms touch the wearer's torso during the swinging of a racquet or club, contact is made at a thin portion of the garment. All the other sections of the garment are thicker for thermal insulation. Thus, it can be seen that the garment of the present invention is designed to provide a maximum amount of thermal insulation while permitting a relatively free swinging motion of the wearer's arms with the use of relatively thin and thick selected areas of the garment. The thin outer layer is lined with a thicker insulating material except for the underarm areas between the wearer's inner arms and the wearer's torso as defined where the arms touch the torso during the swinging motion of a racquet or club.

In an alternative embodiment, a thin material and a thick material could be used separately rather than layered to construct the garment of the present invention. The thin material would be used to cover the left and right inner torso areas 18 and 20 and the left and right inner arm areas 22 and 24 while the thick material would cover the balance of the garment. Seams would be used to join the thin and thick materials.

While the invention has been described with reference to a particular embodiment thereof, those skilled in the art will be able to make various modifications to the described embodiments without departing from the true spirit and scope of the invention. It is intended that all devices and processes which are equivalent to those in that they perform substantially the same function in substantially the same way to achieve the same result are within the scope of the invention. Various changes in the shape, size and arrangement of parts may be resorted to without departing from the spirit of the invention or scope of the subjoined claims.

What is claimed is:

1. A garment for providing maximum thermal insulation while allowing freedom of arm motion comprising:

a front panel covering the front of the torso of a wearer, said front panel having a front outer layer and a front inner layer attached to said front outer layer;

a rear panel covering the back of the torso of a wearer, said back panel having a rear outer layer and a rear inner layer attached to said rear outer layer;

a tubular sleeve joined to said front panel and to said rear panel, said sleeve having a sleeve outer layer and a sleeve inner layer attached to said sleeve outer layer, said tubular sleeve forming an underarm area with said front panel and said rear panel;

an inner torso area extending horizontally from approximately said underarm area forward to approximately a midpoint of the wearer's ribcage and extending vertically from said tubular sleeve downward to approximately the bottom of the wearer's ribcage where said front inner layer and said rear inner layer is removed from said inner torso area;

an inner arm area extending horizontally from approximately the midpoint of the front of said tubular sleeve rearward past said underarm area where said sleeve inner layer is removed from said inner arm area.

2. The garment of claim 1, wherein said front outer layer and said rear outer layer and said sleeve outer layer are made of a relatively thin material and where said front inner layer and said rear inner layer and said sleeve inner layer are made of a relatively thick material.

3. A garment for the playing of sports comprising:

a torso section covering substantially all of the upper trunk of the body of a wearer having at least three apertures therein, a first aperture for passage of the wearer's neck and a second aperture and a third aperture for passage of the wearer's arms therethrough;

a pair of sleeves attached to said second and said third apertures respectively;

an underarm section defined where said torso section directly opposes said sleeves during a swinging motion by the wearer;

a thin area of said garment covering said underarm section; and a thick area of said garment covering all of said garment except said thin area, where said thin area has one layer of a first material and said thick area has two layers, a first layer of said first material and a second layer of a second material.

4. The garment of claim 3, wherein said first material is a nylon material and said second material is a thermal insulating material.

5. A garment for the playing of sports comprising:

a torso section covering substantially all of the upper trunk of the body of a wearer having at least three apertures therein, a first aperture for passage of the wearer's neck and a second aperture and a third aperture for passage of the wearer's arms therethrough;

a pair of sleeves attached to said second and said third apertures respectively;

an underarm section defined where said torso section directly opposes said sleeves during a swinging motion by the wearer;

a thin area of said garment covering said underarm section; and a thick area of said garment covering all of said garment except said thin area, where said thin area is constructed of a first material and said thick area is constructed of a second material, said first material being comprised of one layer and said second material being comprised of at least two layers.

* * * * *